US005162293A

United States Patent [19]

Nakayama et al.

[11] Patent Number: 5,162,293

[45] Date of Patent: Nov. 10, 1992

[54] THERMAL TRANSFER RECORDING MATERIAL

[75] Inventors: Noritaka Nakayama, Hachioji; Toyoaki Masukawa, Hinode; Takashi Uchida, Hachioji, all of Japan

[73] Assignee: Konica Corporation, Tokyo, Japan

[21] Appl. No.: 693,290

[22] Filed: Apr. 30, 1991

[30] Foreign Application Priority Data

May 2, 1990 [JP] Japan ..... 2-116434

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

FOREIGN PATENT DOCUMENTS 0279467 8/1988 European Pat. Off. ..... 503/227

*Primary Examiner*—Bruce H. Hess

*Attorney, Agent, or Firm*—Finnegan, Henderson, Farabow, Garrett and Dunner

[57] ABSTRACT

A thermal transfer material applied with a cyan die which has features of improved thermal diffusibility, thermal resistance, and hue, is disclosed.

The dye is represented by the following formula I:

FORMULA I wherein $R_1$ represents substituents; A and A' represent each an aryl group; X represents a hydroxyl group or —N(R)R' in which R and R' represent each an alkyl group allowable to have a substituent.

10 Claims, 1 Drawing Sheet

THERMAL TRANSFER RECORDING MATERIAL

FIELD OF THE INVENTION

This invention relates to a thermal transfer recording material and, particularly, to a novel thermal transfer recording material containing a cyan dye which is excellent in spectral characteristics and also in heat resistance.

BACKGROUND OF THE INVENTION

For a method of obtaining color hard copies, the color recording techniques of the ink-jet recording system, electrophotographic recording system, the thermal transfer recording system, and so forth have been studied.

Among the techniques, the thermal transfer recording system, in particular, has the advantages that the operations and maintenance can readily be performed, the apparatuses can be miniaturized, and the production costs can also be saved. In addition to the above, the inexpensive running costs can further be enjoyed as the other advantage thereof.

The thermal transfer recording systems of this type may be classified into the following two kinds; namely, one system, that is so-called a fusion transfer system, in which a transfer sheet comprising a support bearing thereon a fusible ink layer, (the sheet is hereinafter sometimes referred to as a thermal transfer material), is heated by means of a thermal head and the ink is then fusibly transferred over to a sheet subject to the ink transfer, (the sheet is hereinafter sometimes referred to as a transfer image recipient material); and the other system, that is so-called a thermal diffusion transfer system, in which a transfer sheet comprising a support bearing thereon an ink layer containing a thermally diffusible dye, (i.e., a sublimable dye), such transfer sheet is heated by means of a thermal head and the thermally diffusible dye is then transferred over to the transfer image recipient sheet. The latter, the thermal diffusion transfer system, is more advantageous to a full-color recording operation, because an image gradation can be controlled by varying an amount of a dye to be transferred so as to meet the thermal energy variations of a thermal head used.

In the thermal transfer recording operated in the thermal diffusion transfer system, the dyes applied to a thermal transfer materials are an essential element, because they are a great influence on a transfer recording speed, an image quality, and an image storage stability.

Therefore, the dyes applicable to the above-described thermal diffusion transfer system are required to have the following characteristics:

(1) The dyes are to readily be thermally diffused (i.e., they are to readily be sublimated) under the thermal recording conditions (such as the temperature of a head and the time of heating the head);

(2) The dyes are to have a hue desirable for a color reproduction;

(3) The dyes are not to be thermally decomposed at any heating temperature in recording operations;

(4) The dyes are to be excellent in resistance against light, heat, humidity, and chemicals;

(5) The dyes are to have a substantially greater molar absorptivity coefficient;

(6) The dyes are to readily be added to a thermal transfer material; and (7) The dyes are to readily be synthesized.

In this invention, the term, 'a thermal diffusion', hereinafter means that an independent dye is substantially diffused and/or transferred when a thermal transfer material is heated and the dye is in the form of gas, liquid or solid depending on the heat energy applied; and the term is substantially synonymous with the term, 'a sublimation transfer', that is named in the art.

As for the cyan dyes for thermal transfer materials, naphthoquinone dyes, anthraquinone dyes and azomethine dyes have so far disclosed in, for example, Japanese Patent Publication Open to Pubic Inspection (hereinafter referred to as Japanese Patent O.P.I. Publication) Nos. 59--78896/1984, 59-227948/1984, 60-24996/1985, 60-53563/1985, 60-130735/1985, 60-131292/1985, 60-239289/1985, 61-19396/1986, 61-22993/1986, 61-31292/1986, 61-31467/1986, 61-35994/1986, 61-49893/1986, 61-148269/1986, 62-191191/1987, 63-91288/1988, 63-91287/1988 and 63-290793/1988. However, there have not been any dyes found to satisfy all the above-given characteristic requirements. It have, therefore, been demanded to develop a cyan dye having each of the improved thermal diffusibility, hue, and the resistance against heat and light, and a thermal transfer material applied with the improved dye.

From the viewpoints mentioned above, the present inventors have devoted themselves to studying the dyes for thermal transfer materials and they have discovered unexpectedly that the compounds having the following formula I can satisfy the foregoing characteristic requirements and the compounds have an excellent hue. Based on the discovery, the invention could finally be achieved.

SUMMARY OF THE INVENTION

It is, accordingly, an object of the invention to provide a thermal transfer material applied with a cyan dye having the foregoing characteristics including, particularly, each of the improved thermal diffusibility, thermal resistance, and hue.

The objects of the invention can be achieved with a thermal transfer recording material comprising a support provided thereonto with a thermally sensitive layer containing a compound at least represented by the following formula I:

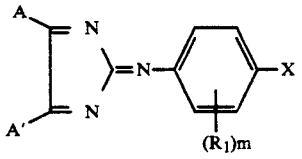

Formula I wherein $R_1$ represents a hydrogen atom, a halogen atom, an alkyl group, a cycloalkyl group, an aryl group, an alkenyl group, an aralkyl group, an alkoxy group, an aryloxy group, a cyano group, an acylamino group, an alkylthio group, a sylfonylamino group, a ureido group, a carbamoyl group, a sulfamoyl group, an alkoxycarbonyl group, an aryloxycarbonyl group, a sulfonyl group, an acyl group, and an amino group;

A and A' represent each an aryl group;

X represents a hydroxyl group or —N(R)R' (in which R and R' represent each an alkyl group allowable to have a substituent.);

m is an integer of 1 to 4. Further, in the formula I, $R_1$ and R, or R and R', may be coupled to each other so as to form a ring; and, when m is not less than 2, $R_1$s may be coupled to each other so as to form a ring.

DETAILED DESCRIPTION OF THE INVENTION

Figure 1:
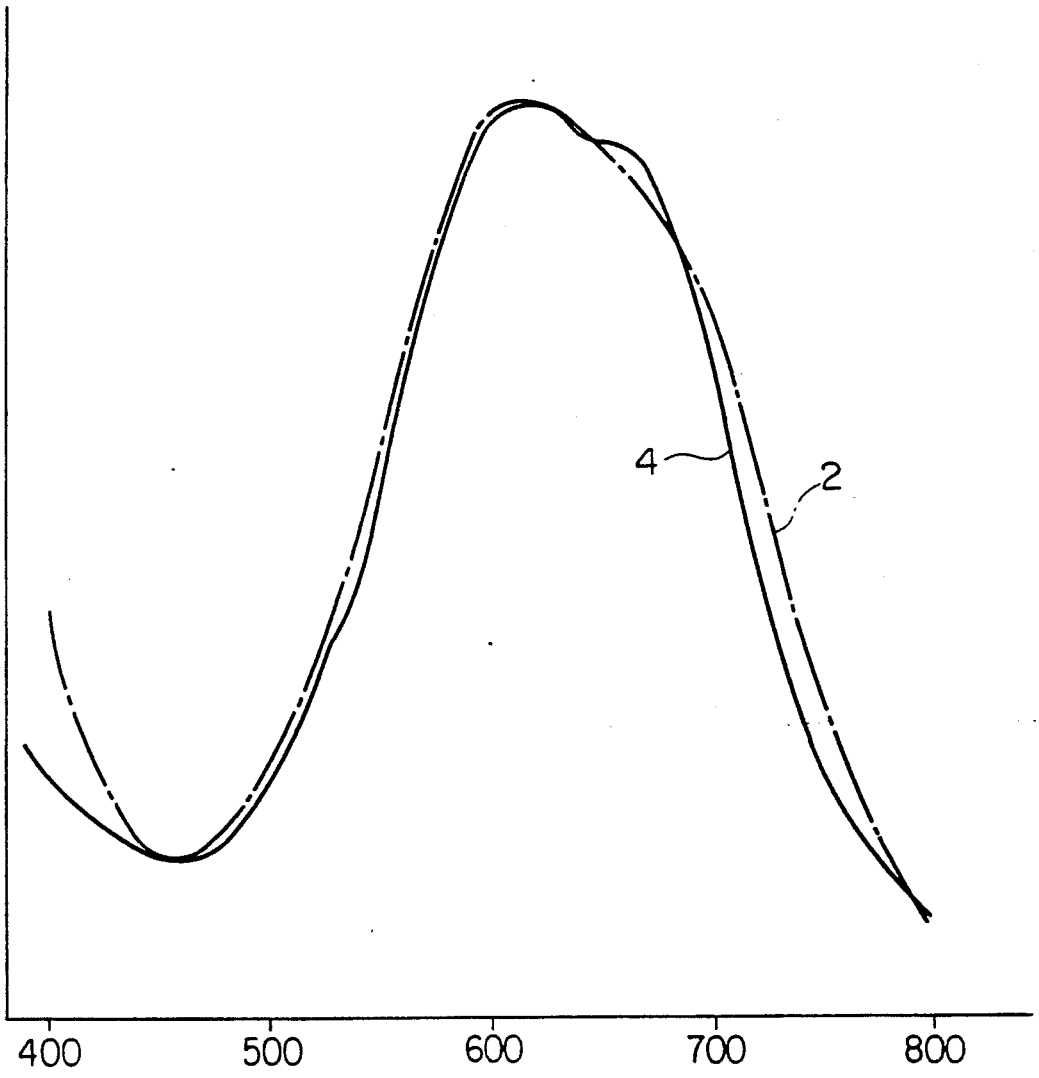
FIG. 1 is a graph exhibiting two spectral absorption curves, wherein reference numeral 2 indicates the curve for comparative sample No. 2 and 4 indicates the curve for inventive sample No. 4.

Now, the invention will be detailed below.

In formula I applicable to the invention, $R_1$ represents a hydrogen atom, a halogen atom (such as a chlorine or fluorine atom), an alkyl group (such as a methyl, ethyl, isopropyl or n-butyl group), a cycloalkyl group (such as a cyclopentyl or cyclohexyl group), an aryl group (such as a phenyl group), an alkenyl group (such as a 2-propenyl group), an aralkyl group (such as a benzyl or 2-phenytyl group), an alkoxy group (such as a methoxy, ethoxy, isopropoxy or n-butoxy group), an aryloxy group (such as a phenoxy group), a cyano group, an acylamino group (such as an acetylamino or propionylamino group), an alkylthio group (such as a methylthio, ethylthio or n-butylthio group), an arylthio group (such as a phenylthio group), a sulfonylamino group (such as a methanesulfonylamino or benzenesulfonylamino group), a ureido group (such as 3-methylureido or 3,3-dimethylureido group), a carbamoyl group (such as amethylcarbamoyl, ethylcarbamoyl or dimethylcarbamoyl group), a sulfamoyl group (such as an ethylsulfamoyl or dimethylsulfamoyl group), an alkoxycarbonyl group (such as a methoxycarbonyl or ethoxycarbonyl group), an aryloxycarbonyl group (such as a phenoxycarbonyl group), a sulfonyl group (such as a methanesulfonyl, butanesulfonyl or phenylsulfonyl group), an acyl group (such as an acetyl, propanoyl or butyloyl group), or an amino group (such as a methylamino, ethylamino or dimethylamino group).

The above-given groups may further be substituted. The substituents include, for example, an alkyl group (such as a methyl, ethyl or trifluoromethyl group), an aryl group (such as a phenyl group), an alkoxy group (such as a methoxy or ethoxy group), an amino group (such as a methylamino or ethylamino group), an acylamino group (such as an acetyl group), a sulfonyl group (such as a methanesulfonyl group), an alkoxycarbonyl group (such as a methoxycarbonyl group), a cyano group, a nitro group, and a halogen atom (such as a chlorine or fluorine atom).

The groups represented by $R_1$ are desirable to have not more than 12 carbon atoms (and, preferably, not less than 8 carbon atoms).

The compounds represented by formula I include, preferably, those represented by the following formula II in which A represents a phenyl group.

Formula II

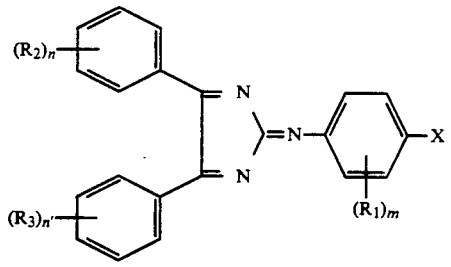

wherein $R_1$ and X represent each the same as denoted in formula I; $R_2$ and $R_3$ represent each a substituent; and n and n' are each an integer of 0 to 5, provided, when n and n' are each not less than 2, $R_2$ and $R_3$ each may be the same with or the different from each other.

Next, the compounds represented by Formula II will now be detailed.

In Formula II, there is no special limitation to the substituents represented each by $R_2$ and $R_3$, and the substituents include, for example, a halogen atom, a hydroxyl group, a cyano group, a nitro group, a carboxyl group, an alkyl group, an alkoxy group, a carbamoyl group, a sulfamoyl group, an acyl group, an acyloxy group, an alkoxycarbonyl group, an —$NHCOR_4$ group, an —$NHSO_2R_4$ group, an —$NHCON(R_4)R_5$ group, an —$NHCOOR_4$ group, an —$NHSO_2R_4$ group, and an —$NHSO_2N(R_4)R_5$ group.

The alkyl groups represented by $R_2$ and $R_3$ include a straight chained or branched alkyl group having 1 to 12 carbon atoms and, preferably, a straight chained or branched alkyl group having 1 to 8 carbon atoms, such as a methyl, ethyl or butyl group.

The alkyl groups given above may be substituted. They may also include a cycloalkyl group such as a cyclohexyl group and, preferably, a halogen atom, a sulfo group, and an alkoxy group having 1 to 8 carbon atoms.

The alkoxy groups include, preferably, a straight chained or branched alkoxy group having 1 to 12 carbon atoms, such as a methoxy, ethoxy, i-propyloxy or octyloxy group.

The carbamoyl groups include, for example, a substituted alkylcarbamoyl group such as an ethylcarbamoyl or butyloxypropyl carbamoyl group.

The sulfamoyl groups also include, for example, a nonsubstituted alkylsulfamoyl group such as an ethylsulfamoyl or diethylsulfamoyl group, and a substituted alkylsulfamoyl group such as a butyloxypropylsulfamoyl group.

The arylcarbamoyl groups include, for example, a phenylcarbamoyl group and a substituted phenylcarbamoyl group.

The arylsulfamoyl groups also include, for example, a phenyl sulfamoyl group and a variety of substituted phenyl sulfamoyl groups.

There also include, for example, a sulfonyloxy groups such as an acetyl, benzoyl, butanesulfonyl, benzenesulfonyl group, and an alkoxycarbonyl group such as an ethoxycarbonyl, i-propyloxycarbonyl or 2-ethylhexyloxycarbonyl group.

The —$NHCOR_4$ groups represent each an alkylamido group having 1 to 12 carbon atom. The typical examples of the nonsubstituted alkylamido groups include an acetamido or butanamido group.

The above-given groups may be those such as a cyclohexanecarbonamido group, and they may have a branched structure such as that of a 2-ethylhexanamido group and, further, they may contain an unsaturated bond.

The substituted alkylamido groups include, for example, a halogen-substituted alkylamido group such as a monochloracetamido, trichloracetamido or perfluorobutanamido group and a substituted alkylamido group such as a phenoxyacetamido group.

The —$NHCOR_4$ groups represent each an arylamido group including, typically, a non-substituted arylamido group such as a benzamido or naphthamido group.

The substituted arylamido groups include, for example, an alkyl-substituted benzamido group such as a p-t-butylbenzamido or p-methylbenzamido group, an alkoxy-substituted benzamido group such as a p-methoxybenzamido group, an amido-substituted benzamido group such as a p-acetamidobenzamido group, and a sulfonamido-substituted benzamido group such as a p-butanesulfonamidobenzamido group.

The —$NHCOOR_4$ groups represent each a substituted or non-substituted alkoxycarbonylamino group having 1 to 12 carbon atoms, which include, typically, an ethoxycarbonylamino, i-propoxycarbonylamino, octyloxycarbonylamino or methoxyethoxycarbonylamino group.

The —$NHCOOR_4$ groups also represent an aryloxycarbonyl group including, typically, a dimethylcarbamoylamino or diethylcarbamoylamino group.

The —$NHSO_2R_4$ groups represent each an alkylsulfonamido or arylsulfonamido group.

The alkylsulfonamido groups include, for example, a nonsubstituted alkylsulfonamido group having 1 to 12 carbon atoms, such as a methanesulfonamido, butanesulfonamido or dodecanesulfonamido group, and a substituted alkylsulfonamido group such as a benzylsulfonamido group.

The arylsulfonamido groups may be exemplified by a substituted arylsulfonamido group including, for example, a non-substituted arylsulfonamido group such as a benzenesulfonamido or naphthalenesulfonamido group, an alkyl-substituted benzenesulfonamido group such as a p-toluenesulfonamido, or 2,4,6-trimethylbenzenesulfonamido group, and an alkoxy-substituted benzenesulfonamido group such as a p-dodecyloxybenzenesulfonamido or butyloxybenzenesulfonamido group.

The —$NHSO_2N(R_4)R_5$ groups represent each a sulfamoylamino group including, typically, a dialkylsulfamoylamino group including, preferably, a dimethylsulfamoylamino or dibutylsulfamoylamino group.

$R_4$ and $R_5$ represent each, preferably, a hydrogen atom, an alkyl group, or an aryl group, provided, $R_4$ and $R_5$ are allowed to form a heterocyclic ring upon coupling each other.

The alkyl groups each represented by $R_4$ and $R_5$ include, preferably, a straight chained or branched alkyl group having 1 to 12 carbon atoms and, besides, the alkyl groups also include a cycloalkyl group such as a cyclohexyl group. The above-given alkyl groups may also be substituted. The typical substituents include, preferably, a halogen atom, a hydroxyl group, a carboxyl group, a cyano group, a sulfo group, and an alkoxy group having 1 to 22 carbon atoms.

The aryl groups represented by $R_4$ and $R_5$ include, preferably, a phenyl group which may also be substituted with a nitro, amino or sulfonamido group.

The heterocyclic rings each formed by coupling $R_4$ and $R_5$ together are preferably those of 5- or 6-membered ring.

The compounds represented by formula I applicable to the invention (hereinafter referred to as the compounds applicable to the invention) can be prepared in the well-known synthesizing processes such as that in which a coupler represented by the following formula III is subjected to an oxidation coupling reaction with either one of a p-phenylenediamine derivative or a p-aminophenol derivative.

The above-mentioned coupling reaction may be carried out preferably in the basic conditions, and the reaction medium may be any one of an organic solvent, an aqueous organic solvent and an aqueous solution.

The oxidizers applicable thereto may be any one, provided, they have a potential capable to oxidize the p-phenylenediamine derivative or the p-aminophenol derivative. The oxidizers applicable thereto include, for example, an inorganic oxidizer such as silver halide, hydrogen peroxide, manganese dioxide, potassium persulfate and oxygen, or a variety of organic oxidizers such as N-bromosuccinimide and chloramine T.

The synthesization can be performed by making an electrode reaction, when suitably selecting an electric current, a voltage, a supporting electrolyte, a solvent and an electrode.

As described above, the cyan dyes applicable to the invention can be prepared by making a coupling reaction of a coupler represented by formula III with a p-phenylenediamine derivative or a p-aminophenol derivative. The couplers mentioned above can be synthesized in the processes such as a Ber. 34,639, Franz Kunckell's process.

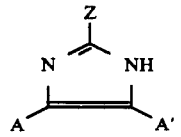

Formula III wherein A and A' are each synonymous with those defined in Formula I; and Z represents an elimination group (such as a chlorine atom) or a hydrogen atom, which can be eliminated in an oxidation coupling reaction with a p-phenylenediamine derivative or a p-aminophenol derivative.

Next, the typical examples of the compounds represented by formula I applicable to the invention will be given below. It is, however, to be understood that the invention shall not be limited thereto.

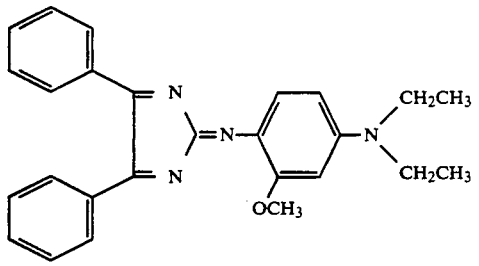
1.
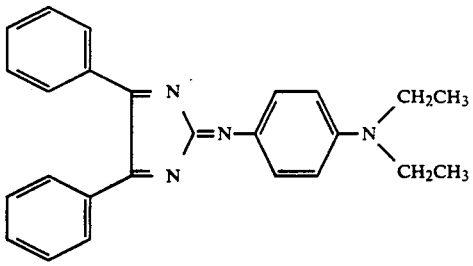
2.
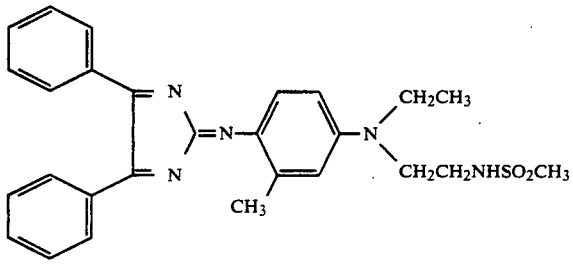
3.
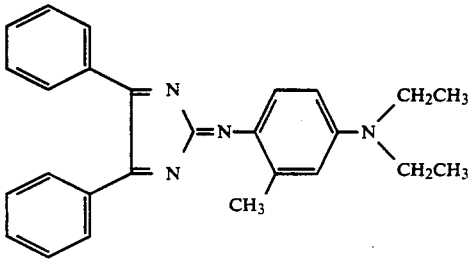
4.
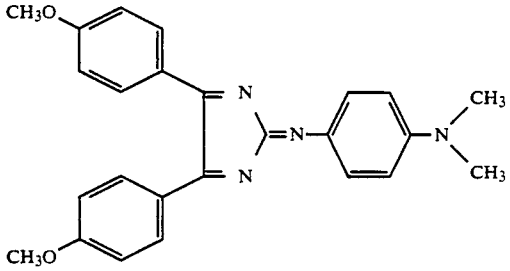
5.
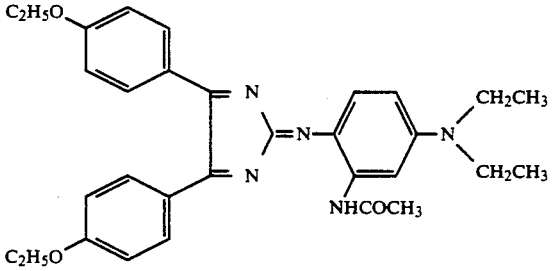
6.
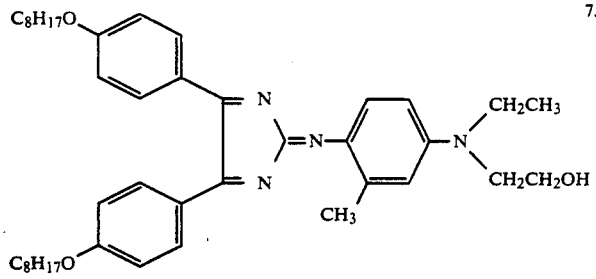
7.
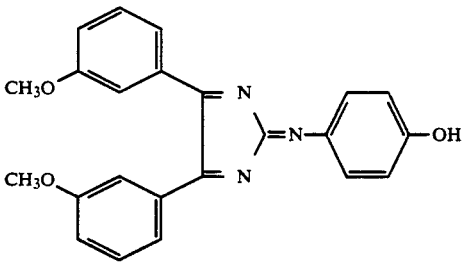
8.
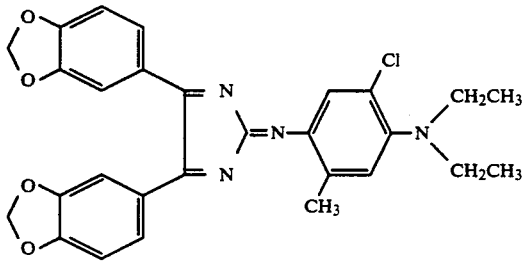
9.
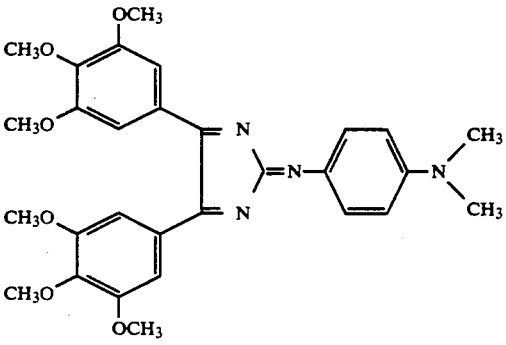
10.

-continued
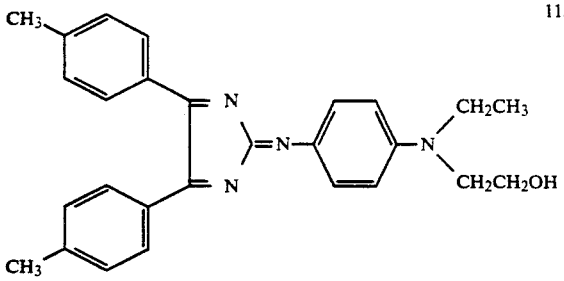
11.
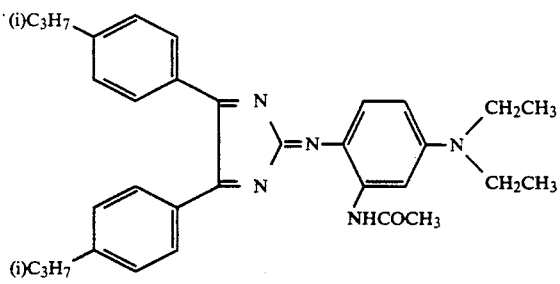
12.
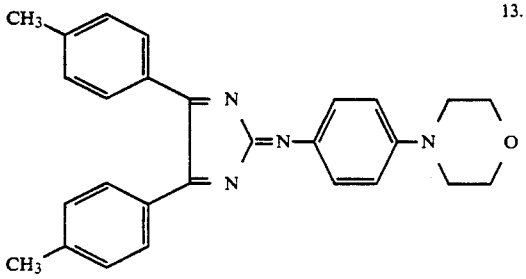
13.
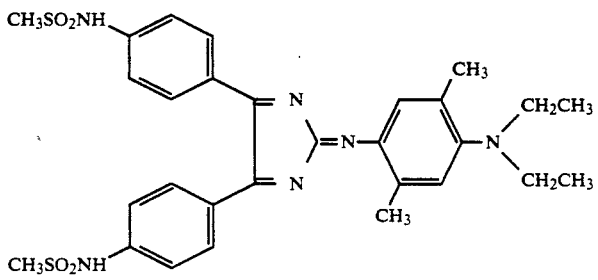
14.
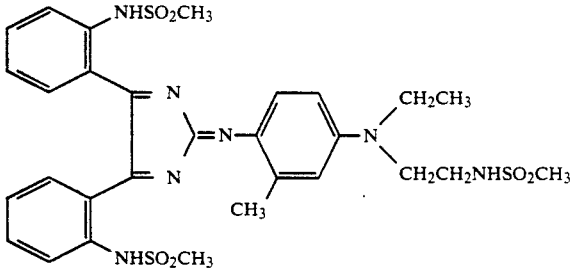
15.
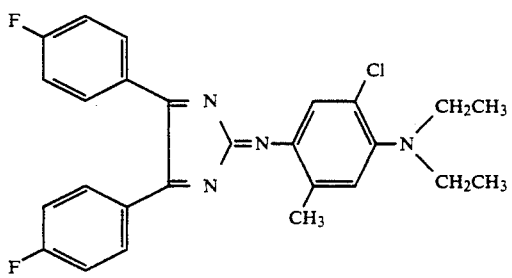
16.
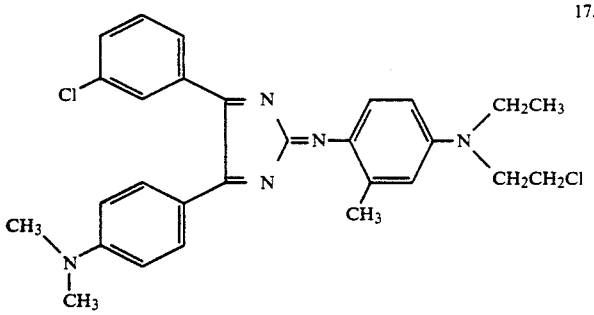
17.
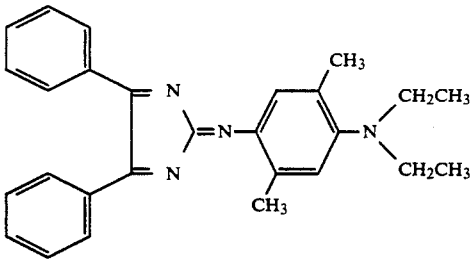
18.
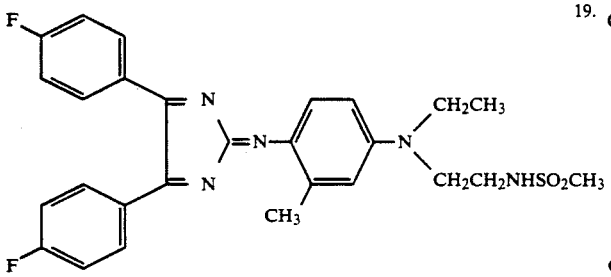
19.
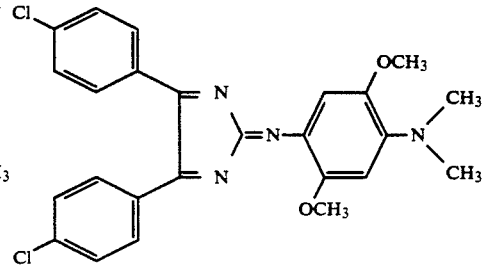
20.

-continued
21.
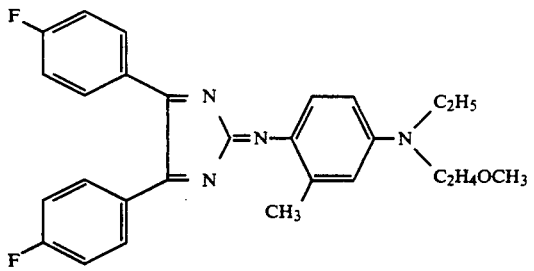
22.
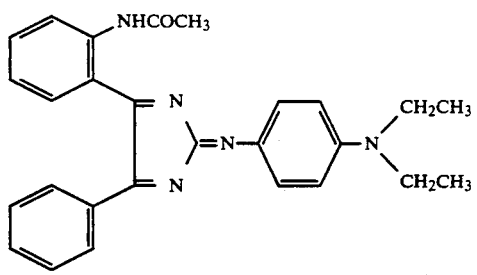
23.
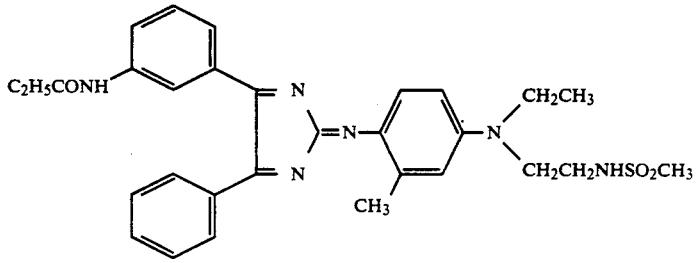
24.
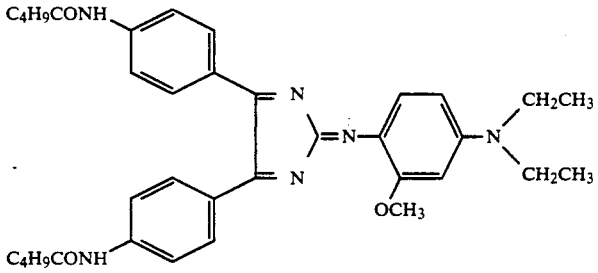
25.
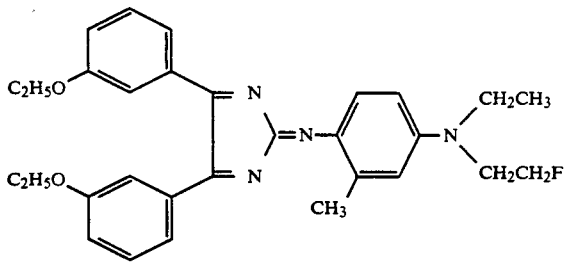
26.
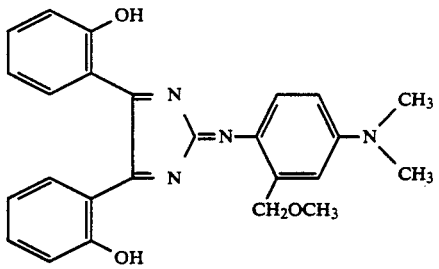
27.
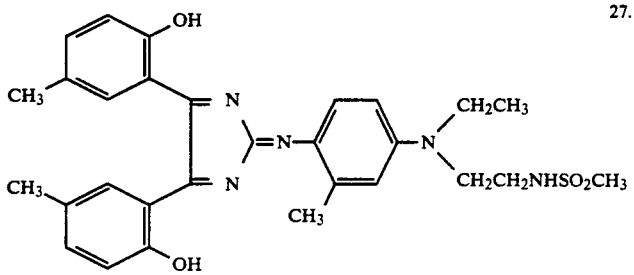
28.
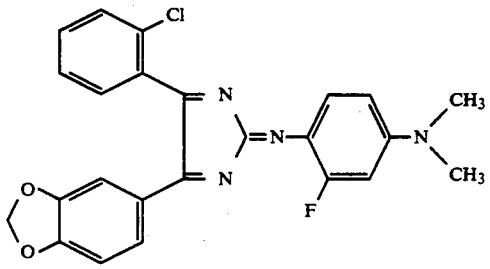

-continued
29.
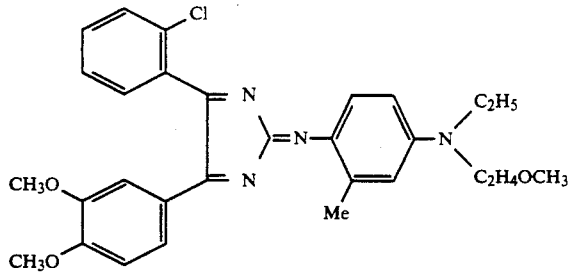
30.
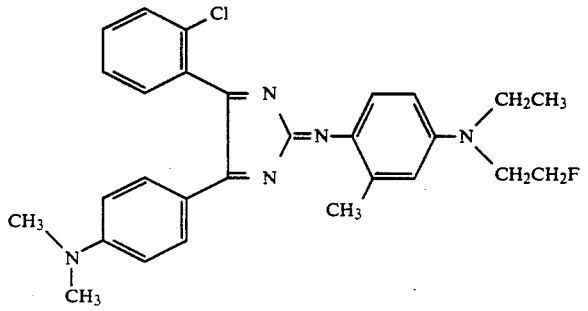
31.
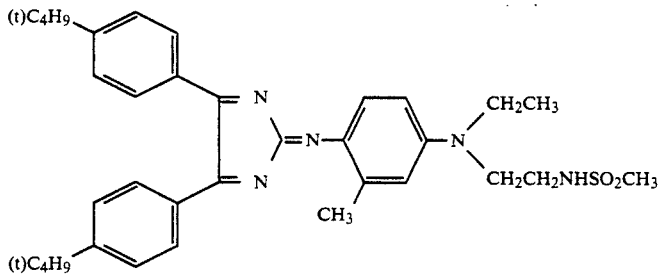
32.
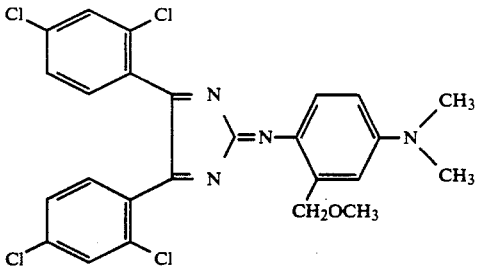
33.
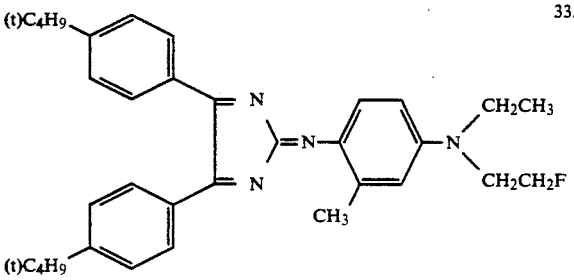
34.
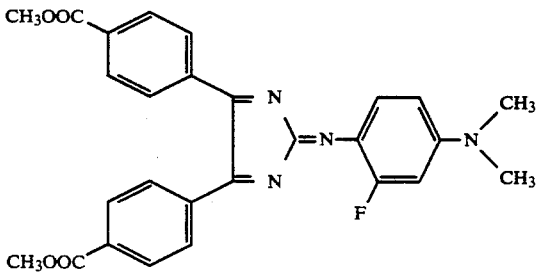

-continued

35.

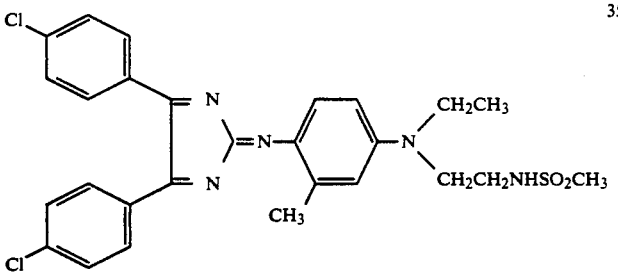

36.

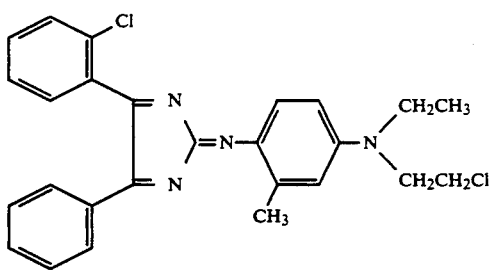

37.

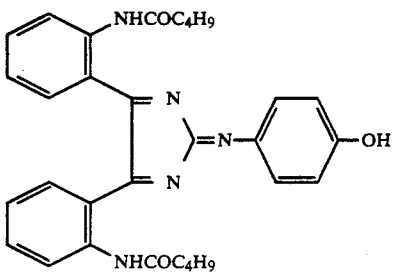

38.

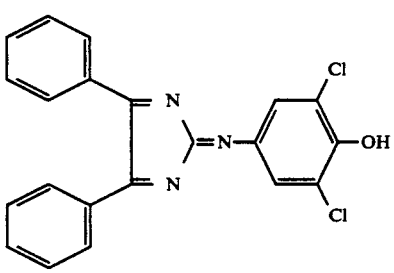

39.

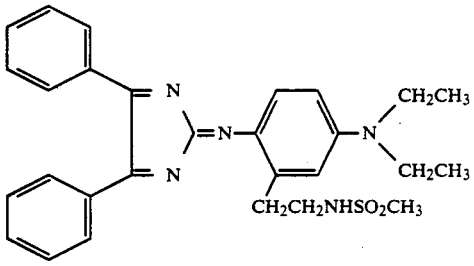

40.

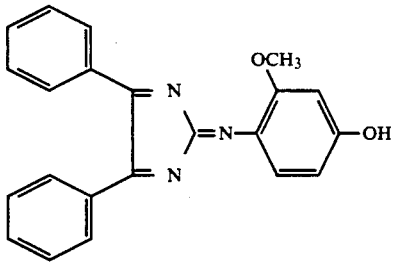

An ink layer or a thermosensitive layer of the thermal transfer materials of the invention can be obtained in such a manner that an ink containing the above-given dye is prepared by either dissolving the dye and a binder into a solvent or by dispersing the dye in the form of fine particles, and the resulting ink is coated over a support and is then dried up.

The dyes applicable to the invention are each used desirably in an amount within the range of 0.1 g to 20 g per sq. meter of the support used.

From each of the thermal transfer materials thus prepared, a dye image can be obtained in an ordinary image forming process such as the following process: An image recipient material is made ready, and the thermosensitive layer and the image recipient layer are put together. When heat is then applied from the backside of a support of the thermal transfer material according to an image information, the dyes are diffused in the image recipient layer according to the thermographic image and the dyes are fixed on the image recipient layer.

The above-mentioned solvents include, for example, water soluble polymers such as those of the cellulose, polyacrylic acid, polyvinyl alcohol and polyvinyl pyrrolidone types, and the polymers soluble to organic solvents, such as acrylic resin, methacrylic resin, polystyrene, polycarbonate, polysulfone, polyether sulfone and ethyl cellulose. In the case of using the polymers soluble to organic solvents, they may be used not only by dissolving them in organic solvents, but also in the form of a latex dispersion.

The binders are used preferably in an amount within the range of 0.1 g to 50 g per sq. meter of a support used.

The supports applicable to the invention may be any one, provided, they have a high dimensional stability and a heat resistance when making a record with a thermal head. The supports include, for example, those made of a thin paper such as condenser paper and glassine paper, and those made of a heat resistive plastic film such as those of polyethyleneterephthalate, polyamide and polucarbonate.

The thickness of the support is preferably within the range of 2 to 30 μm. The supports are also allowed to have a sublayer, with the purposes of improving the adhesion to a binder and preventing the dyes from transferring or dyeing to the support side.

It is further allowed to provide a slipping layer to the backside of a support (i.e., to the opposite side of an ink layer), with the purpose of preventing a head from adhering to the support.

The ink layer, i.e., a thermosensitive layer, applicable to the invention is either coated on a support or printed thereon in a printing process such as a gravure printing process. The dried thickness of the thermosensitive layer is preferably within the range of 0.1 μm to 5 μm.

The solvents for controlling the ink of the thermosensitive layer include, for example, water, alcohols (such as ethanol and propanol), cellosolves (such as ethyl acetate), aromatic compounds (such as toluene, xylene and chlorobenzene), ketones (such as acetone and methylethyl ketone), ethers (such as tetrahydrofuran and dioxane), and chlorine type solvents (such as chloroform and trichlorethylene).

The thermal transfer materials of the invention are basically comprised of a support provided thereon with an ink layer, that is a thermosensitive layer, comprising the dyes and binders each applicable to the invention. The termal transfer materials of the invention are also allowed to have the above-mentioned ink layer provided thereon with a thermofusible layer containing a thermofusible compound such as those described in Japanese Patent O.P.I. Publication No. 59-106997/1984.

In the case where the thermal transfer material of the invention is used for recording a full color image, it is desirable that support (1) is repeatedly coated thereon in order with a cyan ink layer (2) containing the cyan dye relating to the invention, a magenta ink layer (3) containing a thermodiffusible magenta dye, and a yellow ink layer (4) containing a thermodiffusible yellow dye.

Besides the above-mentioned cyan, magenta and yellow ink layers, it is also allowed, if required, to coat a further ink layer containing a black image forming material so that the 4 layers in total may be repeatedly coated in order.

EXAMPLES

The invention will be detailed further with reference to the following examples. It is, however, to be understood that the invention shall not be limited thereto.

EXAMPLE 1

Preparation of the ink for a thermosensitive layer

The mixture having the following composition was treated by means of a paint conditioner, so that a uniform ink solution containing a thermodiffusible dye, that was applicable to the invention, could be so obtained.

| | |
|---|---|
| Exemplified compound Dye-1 | 10 g |
| Polyvinyl butyral resin | 15 g |
| Methylethyl ketone | 150 ml |
| Toluene | 150 ml |

Preparation of a transfer sheet

Thermal transfer material 1 of the invention was prepared by forming a layer containing the thermodiffusible dye relating to the invention on a 15 μm thick polyimide film-made support in such a manner that an ink containing the above-given thermodiffusible dye was coated by making use of a wire bar, so that the coated amount could be 1.0 g/m$^2$ after it was dried.

Similarly, thermal transfer materials 2 through 8 were prepared in the same manner as in thermal transfer material 1, except that Dye-1 used in thermal transfer material 1 was replaced by the dyes shown in Table 1, respectively.

Preparation of an image recipient material

An image recipient material was prepared by coating polyvinyl (in an amount coated of 5 g/m$^2$) on a cast coated paper.

Process of forming a thermal transfer image

The thermal transfer sheets and image recipient materials prepared in the above-described manner were each laid one upon another, respectively, so as to make the ink coated surface of the thermal transfer material opposite to the image receiving surface of the image recipient material. When an image was recorded by applying heat from a thermal head to the backside of the thermal transfer sheet, a contrasty cyan image could be obtained. The maximum densities of the resulting images are shown in Table 1.

The image recording conditions for the above-mentioned recording operations were as follows:

| | |
|---|---|
| Horizontal and vertical scanning densities | 4 dots/mm |
| Recording electricity | 0.8 W/dot |

Time of heating a thermal head: Adjusted stepwise within the range from 20 msec (an applied energy: $11.2\times10^{-3}$J approx.) to 2 msec (an applied energy: $1.12\times10^{-3}$J approx.).

It was proved that the resulting image sharpness could not be varied, even after storing the resulting images. The fastness indicated in the Table 1 is measured as follows:

(1) The samples were stored in 50.C., (2) The surfaces of the samples were scratched with white paper sheets.

(3) An amount of the dye transferred to the white paper sheet was compared by optical densitometer as the amount of Comparative example 1 being 10.

The resulting color densities were measured with an optical densitometer (Model PCA-65 manufactured by Konica Corp.).

(C-1) Dye disclosed in Japanese Patent O.P.I. Publication No. 61-35994/1986

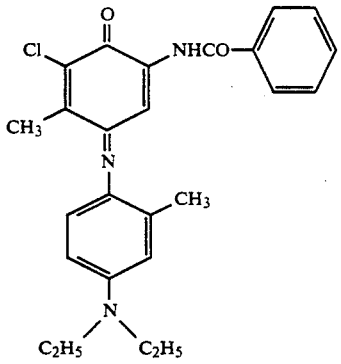

(C-2) Dye disclosed in Japanese Patent O.P.I. Publication No. 61-57651/1986

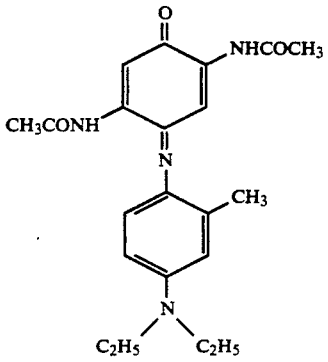

(C-3) Dye disclosed in Japanese Patent O.P.I. Publication No. 60-239289/1985

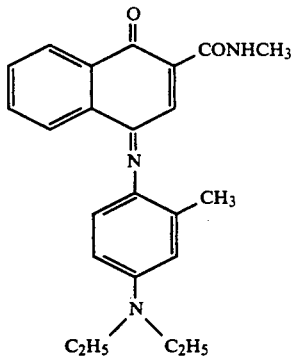

TABLE 1

| Sample No. | Dye | Color *1 density | Fastness |
|---|---|---|---|
| 1 Comparative example | C-1 | 1.4 | 10 |
| 2 Comparative example | C-2 | 1.3 | 3 |
| 3 Comparative example | C-3 | 1.5 | 4 |
| 4 Inventive example | 3 | 2.3 | 1 |
| 5 Inventive example | 6 | 2.2 | 1 |
| 6 Inventive example | 11 | 2.1 | 0 |
| 7 Inventive example | 15 | 2.4 | 1 |
| 8 Inventive example | 37 | 2.1 | 0 |

As is obvious from Table 1, it can be proved that every one of the samples of the invention had a high color density and an excellent fastness, as compared to the comparative samples.

EXAMPLE 2

The spectral absorption of Samples No, 2 and No. 4 both prepared in the above-given example 1 were measured at a density of 1.0, and the results thereof are shown in FIG. 1 attached hereto.

As is obvious from FIG. 1, it was proved that sample No. 4 of the invention was less in side absorption and preferable for color reproducibility, as compared to comparative sample No. 2.

In conclusion, the thermal transfer materials of the invention can provide color images each having the excellently satisfiable thermodiffusibility, hue and heat resistance.

What is claimed is:

1. A thermal transfer recording material comprising: a support provided thereon with a thermosensitive layer containing a compound represented by formula 1:

formula I

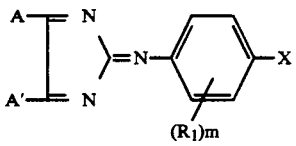

wherein $R_1$ represents a hydrogen atom, a halogen atom, an alkyl, cycloalkyl, aryl, alkeny, arakyl, alkoxy, aryloxy, cyano, acylamino, alkylthio, sulfonylamino, ureido, carbamoyl, sulfamoyl, alkoxycarbonyl, aryloxycarbonyl, sulfony, acyl, and amino group;

A and A' represent each an aryl group;

X represents a hydroxyl group or —N (R) R', wherein R and R' represent each an alkyl group which may have a substituent;

m is an integer of 1 to 4;

d $R_1$ and R, or R and R', may be coupled to each other so as to form a ring; and, when m is more than 2, $R_1$s may be coupled to each other so as to form a ring.

2. The material of claim 1, wherein $R_1$ may have a substituent.

3. A thermal transfer recording material comprising: a support provided thereon with a thermosensitive layer containing a compound represented by formula 11:

formula II

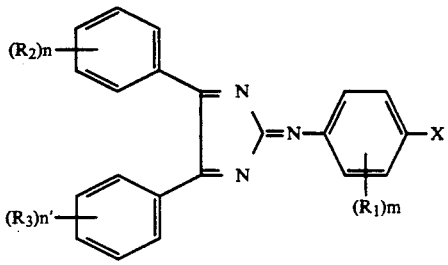

wherein $R_1$ represents a hydrogen atom, a halogen atom, an alkyl, cycloalkyl, aryl, alkenyl, aralkyl, alkoxy, aryoxy, cyano, acyamino, alkylthio, sulfonylamino, ureido, carbamoyl, sulfamoyl, alkoxycarbonyl, aryloxycarbonyl, sulfonyl, acyl, and amino group;

$R_2$ and $R_3$ represent each a substituent, and n and n' are each an integer of 0 to 5, and when n and n' each is more than 2, $R_2$s and $R_3$s each are equal or different;

X represents a hydroxyl group or —N (R) R', wherein R and R' each an alkyl group which may have a substituent;

m is an integer of 1 to 4;

$R_1$ and R, or R and R', may be coupled to each other so as to form a ring; and, when m is more than 2, $R_1$s may be coupled to each other so as to form a ring.

4. The material of claim 1 or 3, wherein number of carbon atoms in $R_1$ is not more than 12.

5. The material of claim 1 or 3, wherein number of carbon atoms in $R_1$ is not more than 8.

6. The material of claim 3, wherein the substituents represented each by $R_2$ and $R_3$ are a halogen atom, a hydroxyl, cyano, nitro, carboxyl, alkyl, alkoxy, carbamoyl, sulfamoyl, acyl, acyloxy, alkoxycarbonyl, —NHCOR$_4$, —NHSO$_2$R$_4$, —NHCON(R$_4$)R$_5$, —NHCOOR$_4$, —NHSO$_2$R$_4$, —NHSO$_2$N(R$_4$)R$_5$ group.

7. The material of claim 6, wherein carbon number in the alkyl group represented by $R_2$ or $R_3$ is not more than 12, straight or branched.

8. The material of claim 7, wherein carbon number in the alkyl group represented by $R_2$ or $R_3$ is not more than 8, straight or branched.

9. The material of claim 3, wherein one or two $R_1$ is positioned next to N connected to.

10. The material of claim 9, wherein $R_1$ is a methyl, ethyl, methoxy, ethoxy, or acetylamino group, or a chlorine atom; X is a hydroxy, dimethyamino, diethylamino, 2-hydroxyethylethylamino, methoxyethylamino group.

* * * * *

UNITED STATES PATENT AND TRADEMARK OFFICE

CERTIFICATE OF CORRECTION

PATENT NO. : 5,162,293

DATED : November 10, 1992

INVENTOR(S) : Noritaka Nakayama et al.

It is certified that error appears in the above-identified patent and that said Letters Patent is hereby corrected as shown below:

Claim 1, Column 19, Line 52, change "1" to --I--;

Claim 1, Column 19, Line 64, change "alkeny" to --alkenyl--;

Claim 1, Column 19, Line 64, change "arakyl" to --aralkyl--;

Claim 1, Column 19, Line 67, change "sulfony" to --sulfonyl--;

Claim 1, Column 20, Line 5, delete "d";

Claim 3, Column 20, Line 14, change "11" to --II--;

Claim 3, Column 20, Line 30, change "aryoxy" to --aryloxy--;

Claim 3, Column 20, Line 30, change "acyamino" to --acylamino--;

Claim 3, Column 20, Line 38, after "R" (2nd occ.) insert--represent--.

UNITED STATES PATENT AND TRADEMARK OFFICE

CERTIFICATE OF CORRECTION

PATENT NO. : 5,162,293

DATED : November 10, 1992

INVENTOR(S) : Noritaka Nakayama, et al.

It is certified that error appears in the above-identified patent and that said Letters Patent is hereby corrected as shown below:

Claim 10, column 20, line 65, change "dimetheyaminol" to --dimethylamino--.

Signed and Sealed this

Twenty-first Day of December, 1993

*Attest:*

Bruce Lehman

BRUCE LEHMAN

*Attesting Officer*

*Commissioner of Patents and Trademarks*